US006491502B2

(12) United States Patent
Hunt

(10) Patent No.: US 6,491,502 B2
(45) Date of Patent: Dec. 10, 2002

(54) CENTER MOUNTED FAN MODULE WITH EVEN AIRFLOW DISTRIBUTION FEATURES

(75) Inventor: Alexander Graham Hunt, London (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/730,109

(22) Filed: Dec. 5, 2000

(65) Prior Publication Data

US 2002/0110462 A1 Aug. 15, 2002

Related U.S. Application Data

(60) Provisional application No. 60/227,174, filed on Aug. 23, 2000.

(51) Int. Cl.[7] ..... F04B 17/00; F04B 35/00

(52) U.S. Cl. ..... 417/360; 417/366; 417/423.5; 415/119; 415/220; 416/169 A; 416/189

(58) Field of Search ..... 417/360, 353, 417/354, 366, 368, 423.5; 415/121.2, 211.2, 119, 220; 416/169 A, 189, 203, 247 R

(56) References Cited

U.S. PATENT DOCUMENTS

| | | | | |
|---|---|---|---|---|
| 4,152,094 A | * | 5/1979 | Honda et al. | 415/119 |
| 4,173,995 A | | 11/1979 | Beck | |
| 4,180,130 A | | 12/1979 | Beck et al. | |
| 4,181,172 A | | 1/1980 | Longhouse | |
| 4,194,556 A | | 3/1980 | Watanabe et al. | |
| 4,210,833 A | * | 7/1980 | Neveux | 310/58 |
| 4,210,835 A | * | 7/1980 | Neveux | 310/62 |
| 4,211,514 A | * | 7/1980 | Hawes | 415/191 |
| 4,329,946 A | | 5/1982 | Longhouse | |
| 4,397,348 A | | 8/1983 | Klem | |
| 4,510,991 A | | 4/1985 | Kawahira | |
| 4,836,148 A | | 6/1989 | Savage et al. | |
| 4,840,221 A | | 6/1989 | Dumas et al. | |
| 4,971,143 A | | 11/1990 | Hogan | |
| 4,979,584 A | | 12/1990 | Charles | |
| 4,991,646 A | | 2/1991 | Spears | |
| 5,024,267 A | | 6/1991 | Yamaguchi et al. | |
| 5,046,554 A | | 9/1991 | Iwasaki et al. | |
| 5,065,814 A | | 11/1991 | Loeber et al. | |
| 5,219,016 A | | 6/1993 | Bolton et al. | |
| 5,277,547 A | * | 1/1994 | Washizu | 415/208.1 |
| 5,342,167 A | | 8/1994 | Rosseau | |
| 5,410,992 A | | 5/1995 | Hunt et al. | |
| 5,427,502 A | | 6/1995 | Hudson | |
| 5,454,695 A | * | 10/1995 | Shah et al. | 416/203 |

(List continued on next page.)

FOREIGN PATENT DOCUMENTS

| | | | | |
|---|---|---|---|---|
| JP | 402171520 A | * | 7/1990 | 165/53 |

*Primary Examiner*—Charles G. Freay
*Assistant Examiner*—Han Lieh Liu

(57) ABSTRACT

A fan shroud structure 10 including a shroud body 12 having a pair of opposing first sides 14 and a pair opposing second sides 16. The first sides 14 are joined with the second sides 16 at corners 18 so as to form a box-like configuration defining an interior space 20. The shroud body has a front end constructed and arranged to be disposed adjacent to a condenser and a back end constructed and arranged to be disposed adjacent to a radiator. Generally annular wall structure 26 is within the interior space and is constructed and arranged to receive blades of a fan within bounds thereof. Vortex preventing structure 40 is provided in each corner near the back end. The vortex preventing structure is constructed and arranged to prevent large scale eddy current generation of air in the corners as air enters the radiator. Air deflecting structure 50 is provided in each corner near the front end. The air deflecting structure is constructed and arranged to deflect incoming air towards the sides, thereby reducing air drawn by the fan from the corners.

23 Claims, 8 Drawing Sheets

U.S. PATENT DOCUMENTS 5,495,909 A 3/1996 Charles
5,520,513 A * 5/1996 Kuroki et al. ..... 415/223
5,649,587 A 7/1997 Plant
5,660,149 A 8/1997 Lakerdas et al.
5,671,803 A * 9/1997 Tepas et al. ..... 165/41
5,758,716 A * 6/1998 Shibata ..... 165/41
5,771,961 A * 6/1998 Alizadch ..... 165/121
5,826,549 A 10/1998 Martin
5,845,612 A 12/1998 Lakerdas et al.
5,884,589 A 3/1999 Sakamoto et al.
5,895,206 A 4/1999 Chuang et al.
5,901,672 A 5/1999 Suzuki et al.
5,901,786 A 5/1999 Patel et al.
5,970,925 A 10/1999 Lakerdas et al.
6,027,307 A * 2/2000 Cho et al. ..... 415/173.5
6,287,078 B1 * 9/2001 Min et al. ..... 416/189

* cited by examiner

CENTER MOUNTED FAN MODULE WITH EVEN AIRFLOW DISTRIBUTION FEATURES

This application is based on and claims priority from U.S. Provisional Application Serial No. 60/227,174 filed on Aug. 23, 2000.

FIELD OF THE INVENTION

The invention generally relates to a fan module for moving air through heat exchangers and more particularly to a fan module having features that permit for an even distribution of airflow from a rectangular heat exchanger to a round fan of the fan module and to another rectangular heat exchanger.

BACKGROUND OF THE INVENTION

Fan modules function to move air through heat exchangers. The heat exchangers are usually grouped together and the fan module is placed upstream (pusher module) or downstream (puller module) the heat exchanger grouping. Typically the heat exchangers are rectangular and the fan orifice is round. Given sufficient distance between the heat exchangers and the fan module the steamlines of air have room to adapt from the one shape to the other. The adapting of streamlines allows an even distribution of air through both the heat exchangers and fan orifice. The heat exchanger aerodynamic losses are minimized by an even flow distribution. The fan performance, aerodynamic and acoustic, is optimized when the airflow is axisymmetric. As used herein, axisymmetric is defined as even distribution of airflow around the fan.

A puller module requires less distance to maintain an even flow distribution. Thus, the use of puller modules is popular since vehicle geometry has changed to require less distance between the fan module and the heat exchangers. Conversely, thermodynamic considerations teach that it requires less work to pressurize low temperature air, which encourages the use of pusher modules. Neither the pusher or puller modules have enough axial distance to ensure an ideal even flow through the heat exchangers. Thus, there is a need to improve the airflow through the heat exchanger for both the pusher and puller module for use in the tight confines of todays vehicle engine compartments.

Conventionally, the shroud portion of the fan module is aerodynamically designed in the area of the support structure of the motor mount ring (stators). The design of the shroud has received little attention. As the gap between the shroud and radiator becomes smaller, the corners of the heat exchanger and the portion behind the hub receive little airfow. The effect of the shroud imposed an aerodynamic loss, by increasing the heat exchanger loss, of a magnitude between the same order and one order less, as the heat exchangers alone. Hence, there is also a need to reduce the aerodynamic losses in the corners of the heat exchangers and reduce the losses at the hub.

SUMMARY OF THE INVENTION

An object of the invention is to fulfill the needs referred to above. In accordance with the principles of the present invention, this objective is achieved by providing a fan shroud structure including a shroud body having a pair of opposing first sides and a pair opposing second sides. The first sides are joined with the second sides at corners so as to form a box-like configuration defining an interior space. The shroud body has a front end constructed and arranged to be disposed adjacent to a condenser and a back end constructed and arranged to be disposed adjacent to a radiator. Generally annular wall structure is within the interior space and is constructed and arranged to receive blades of a fan within bounds thereof. Vortex preventing structure is provided in each corner near the back end. The vortex preventing structure is constructed and arranged to prevent large scale eddy current generation of air in the corners as air enters the radiator. Air deflecting structure is provided in each corner near the front end. The air deflecting structure is constructed and arranged to deflect incoming air towards the sides, thereby improving air distribution into the fan.

In accordance with another aspect of the invention a shroud structure includes a shroud body and motor mount structure coupled to the shroud body. The motor mount structure is constructed and arranged to mount a fan motor thereto and to permit axial flow of air through the motor mount structure to cool the motor. The motor mount structure has surfaces defining a diffuser to convert air entering the motor mount structure at velocity pressure to static pressure as the air exits the motor mount structure.

In accordance with yet another aspect of the invention, a fan module, constructed and arranged to be mounted between a condenser and a radiator, includes a shroud structure and a motor mount structure coupled to the shroud structure. The motor mount structure is constructed and arranged to permit axial flow of air through therethrough. A fan motor is carried by the motor mount structure. A fan hub is driven by the motor for rotation within the shroud structure. The fan hub carries a plurality of fan blades extending radially therefrom to define an axial flow fan. The fan hub including a plurality of hub blades defining a mixed flow impeller. The axial flow fan and the impeller sharing a common axis of rotation thereby defining nested fans to increase the net airflow through the fan module.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
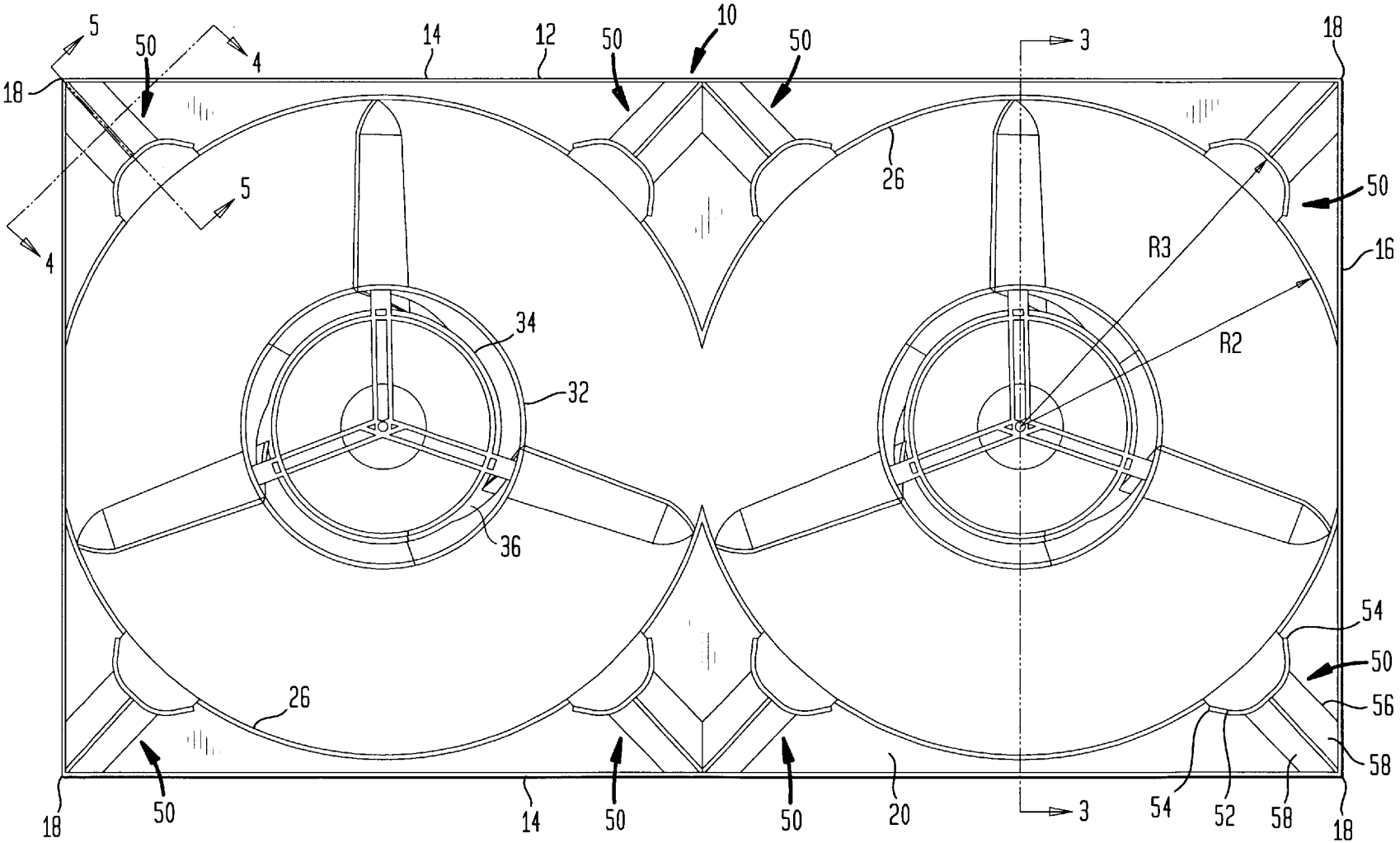
FIG. 1 is a front view of a shroud structure of a fan module having even airflow distribution features, provided in accordance with the principles of the present invention.

With reference to FIG. 1, a front view of a shroud structure, generally indicated at 10, is shown in accordance with the principles of the present invention. The shroud structure 10 is part of a fan module which is configured to be mounted between a rectangular condenser and a rectangular radiator such that the direction of air flow is through the condenser, fan module and radiator in that order. The fan module 11 (FIG. 3) includes the shroud structure 10, an axial flow fan 63, and a motor 31 for driving the fan 63.

Figure 3:
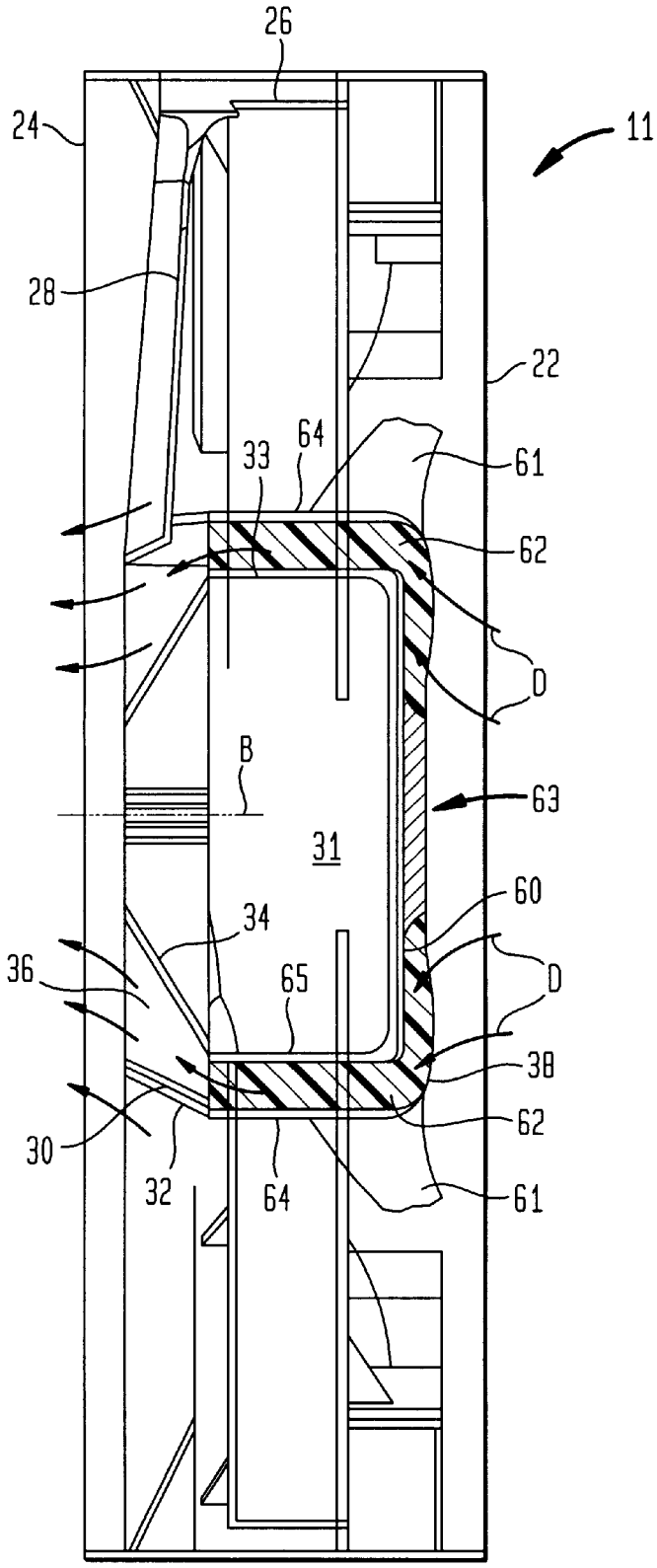
FIG. 3 is a sectional view of the shroud structure taken along the line 3—3 in FIG. 1, and showing a motor, fan hub and blades associated with the shroud structure to define a fan module.
Figure 4:
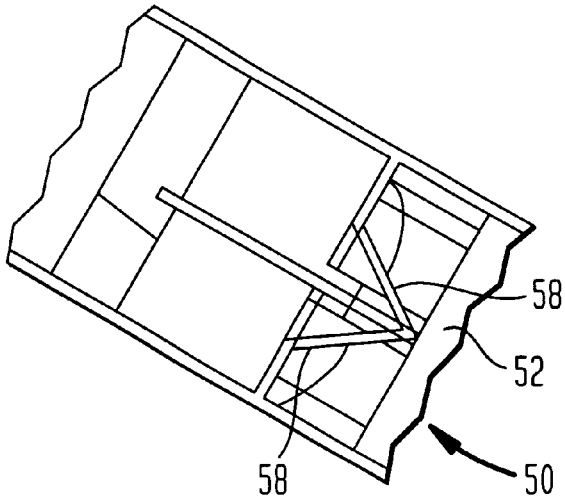
FIG. 4 is a sectional view taken along the line 4—4 in FIG. 1.
Figure 5:
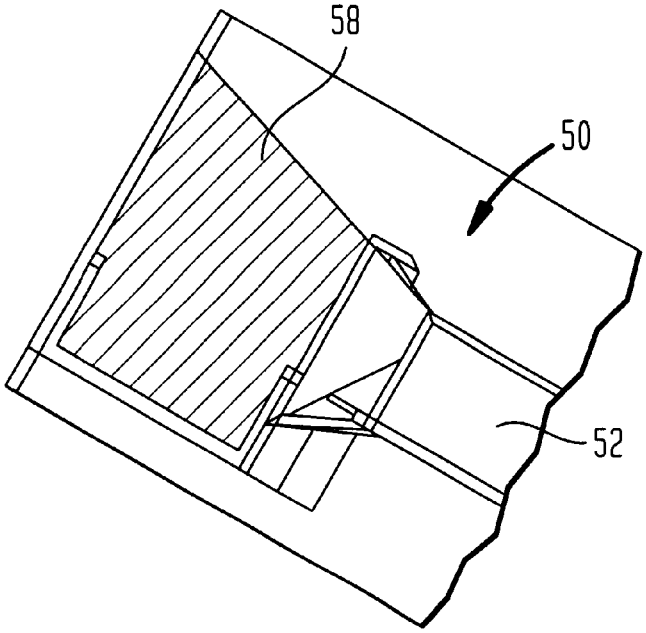
FIG. 5 is a sectional view taken along the line 5—5 in FIG. 1.
Figure 6:
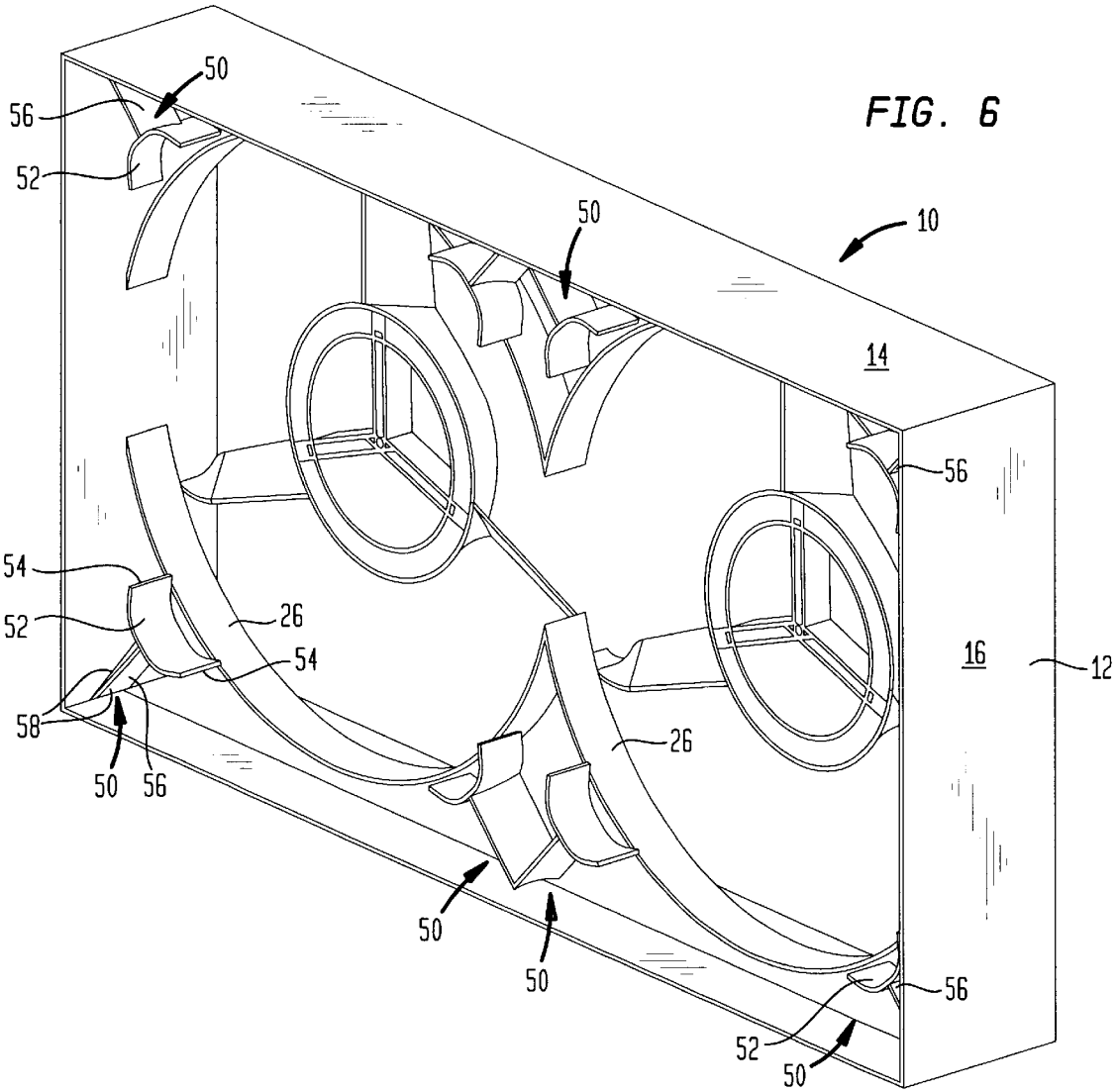
FIG. 6 is a front perspective view of the shroud structure of the invention.

The shroud structure 10 includes a shroud body 12 having a pair of opposing first sides 14 and a pair opposing second sides 16. The first sides 14 are joined with the second sides 16 at corners 18 so as to form a box-like configuration defining an interior space 20. As best shown in FIG. 3, the shroud body 12 has a front end 22 constructed and arranged to be disposed adjacent to a condenser and a back end 24 constructed and arranged to be disposed adjacent to a radiator.

Since the illustrated shroud structure 10 is for a dual fan arrangement, a pair of generally annular wall structures 26 is provided within the interior space 20. It can be appreciated that for a single fan arrangement, only one annular wall structure need be provided. Each wall structure 26 is constructed and arranged to receive blades 61 (FIG. 3) of a associated fan 63 within bounds of the wall structure 26. Thus, the walls structure 26 defines a round fan orifice. Spokes 28 extend from each annular wall structure 26 to an associated motor mount structure 30 such that the motor mount structure 30 is disposed concentrically with the corresponding annular wall structure 26. The motor mount structure 30 carries a motor 31 for driving the fan 63. As best seen in FIG. 3, the motor mount structure 30 is configured to permit axial flow of air for motor cooling. In particular, surfaces parallel to the plane of rotation were eliminated to permit axial flow through the motor mount structure 30. Further, all surfaces of the motor mount structure are used for aerodynamic purposes. Hence, the mount structure 30 is constructed and arranged to function as a conical diffuser to convert air entering the motor mount structure 30 at velocity pressure, to static pressure as the air exits the motor mount structure.

In the illustrated embodiment, the motor mount structure 30 comprises an outer cone member 32 and an inner cone member 34 concentric with the outer cone member 32 to define an air flow space 36 between the inner and outer cone members. The structural members defining the motor mount structure 30 are provided to minimize obstruction of the airflow.

Figure 2:
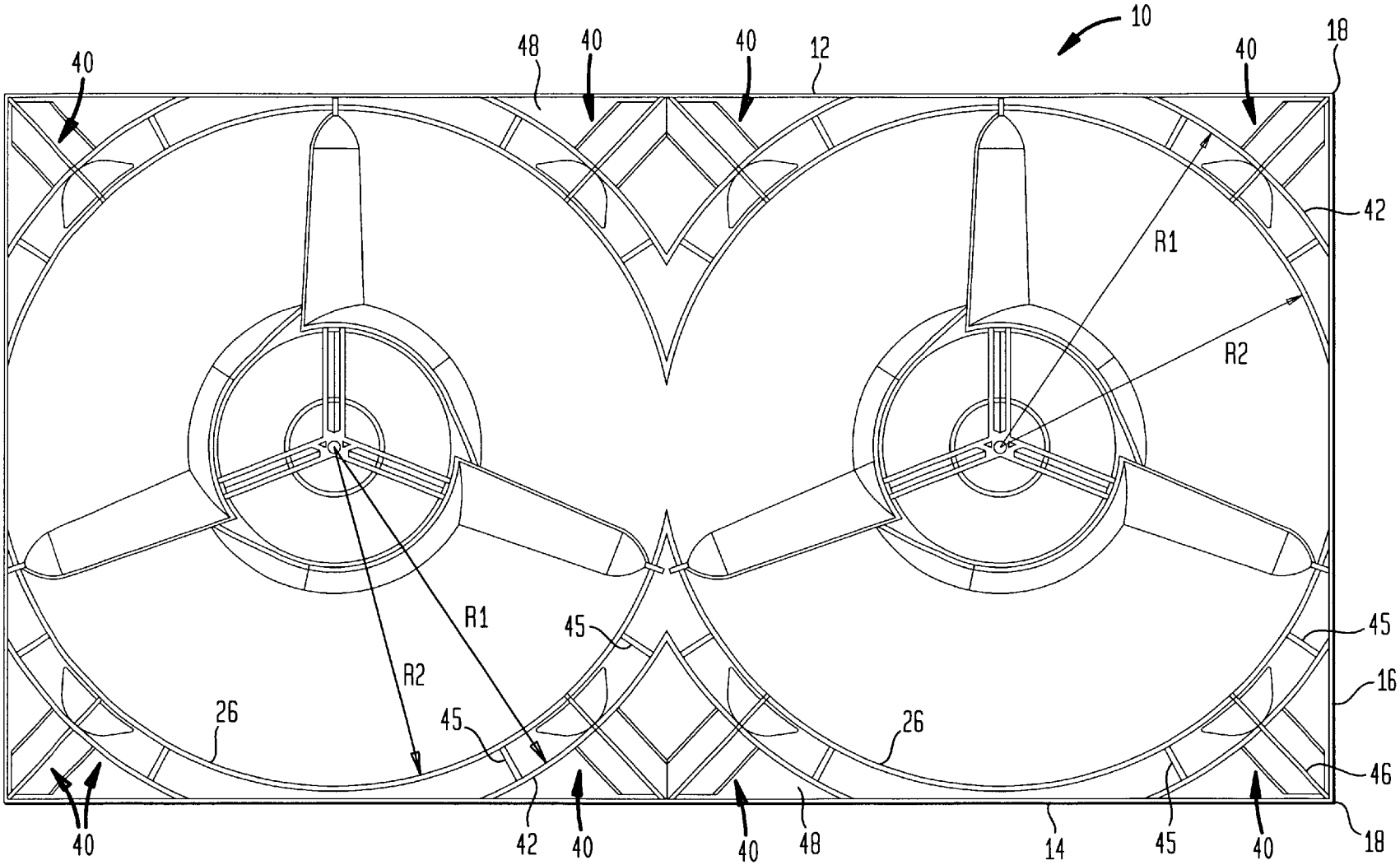
FIG. 2 is a rear view of a shroud structure of a fan module having even airflow distribution features provided in accordance with the principles of the present invention.
Figure 7:
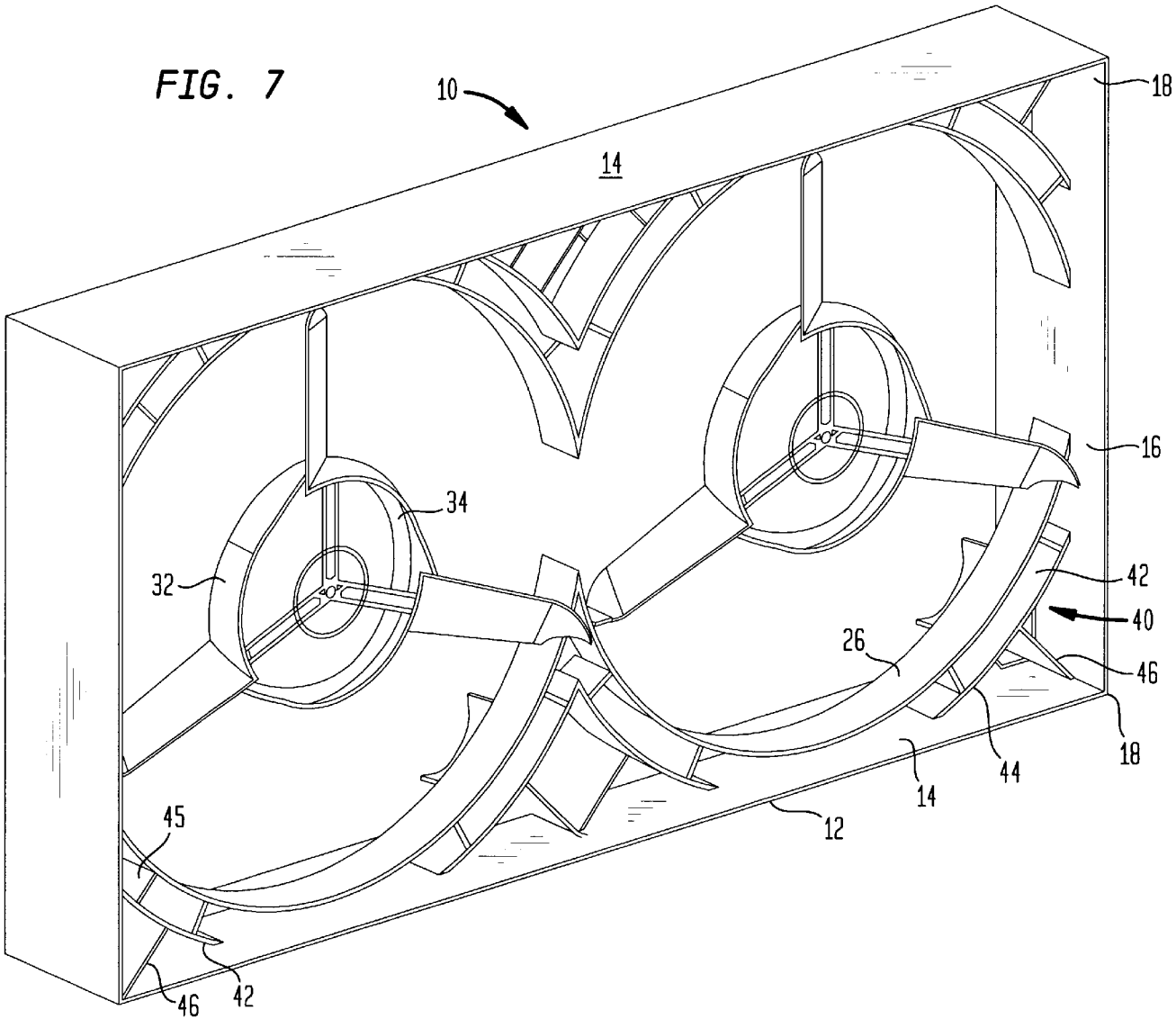
FIG. 7 is a rear perspective view of the shroud structure of the invention.

Since air flows through a rectangular condenser then to a round fan orifice and then to a rectangular radiator, with reference to FIGS. 2 and 7, vortex preventing structure, generally indicated at 40, is provided in each corner 18 near the back end 24 (downstream end) of the shroud body 12. The vortex preventing structure 40 is any structure constructed and arranged to prevent large scale eddy current generation of air in the corners 18 prior to the air entering the radiator. In this description, the vortex preventing structure 40 includes members which are concentric with the fan axis or radially extending from the fan axis. In the illustrated embodiment, the vortex preventing structure 40 comprises an arc-shaped member 42 defined at a radius R1 greater than a radius R2 of the annular wall structure 26. The arc-shaped member 42 joins a first side 14 with a second side 16 at each corner 18 and has an edge 44 (FIG. 7) which extends downstream with respect to the annular wall structure 26. The edge 44 lies on an imaginary control surface which is shaped to provide optimum diffusion from the fan annulus to full radiator face. Ribs 45 are provided to connect the arc-shaped member 42 to the annular wall structure 26. The vortex preventing structure 40 further includes a rib structure 46 extending radially from a juncture of the first and second sides 14 and 16 respectively, to the arc-shaped member 42.

As shown in FIG. 2, in a dual fan arrangement of the shroud structure, upper and lower spaces 48 are defined in the central portion of the shroud body 12 between the pairs of annular wall structures 26. A pair of vortex preventing structures 40 is provided in each of the upper and lower spaces 48 on the downstream side so that one vortex preventing structure in each of the upper and lower spaces 48 is associated with a different annular wall structure 26.

With reference FIG. 1, and 4–6, air deflecting structure, generally indicated at 50, is provided in each corner 18 near the front end 22 (upstream end) of the shroud body 12. The air deflecting structure 50 is any structure constructed and arranged to deflect incoming air circumferentially, thereby reducing air drawn by the fan from the corners 18. In other words, the air deflecting structure 50 is configured to deflect air towards the sides 14 and 16 and away from each corner 18. In the illustrated embodiment, the air deflecting structure 50 comprises a generally cup or U-shaped air deflector 52 disposed at a radius R3 greater than a radius R2 of the annular wall structure 26 and constructed and arranged to separate air flow regions at the corners 18. Ends 54 of the U-shaped air deflector 52 extends towards the annular wall structure 26. The deflecting structure 50 also includes a rib structure 56 extending radially from a juncture of the first and second sides 14 and 16, respectively, to the air deflector 52. Each of the rib structures 56 has a pair of members 58 joined to define an apex directed toward the front end 22 so as to direct incoming air toward the sides 14 and 16.

With reference to FIG. 3, a fan module 11 of the invention is shown wherein the fan hub 38 thereof is constructed and arranged to allow air to enter the fan hub 38 as shown by the arrows D. A plurality of blades 61 are carried by the fan hub 38 in the conventional manner to define a fan, generally indicated at 63. The motor 31 is received in an interior space 33 of the fan hub 38. A clearance 65 is defined between the motor 31 and the fan hub 38. The fan hub 32 includes a disc 60 extending radially with respect to the axis of rotation B. The disc 60 is configured so that it prevents air from passing through the clearance 65 between the motor 31 and the fan hub 38. The disc 60 functions to deflect air towards aerodynamically designed hub blades 62 of the fan hub 38. Thus, the fan hub 38 is designed to function as a mixed flow fan with air entering the fan hub 38 along the axis B and being turned radially by the disc 60 and again axially due to hub wall 64. Air exiting the hub 38 is received by the conical diffuser defined by cone members 32 and 33 of the motor mount structure 30.

Figure 8:
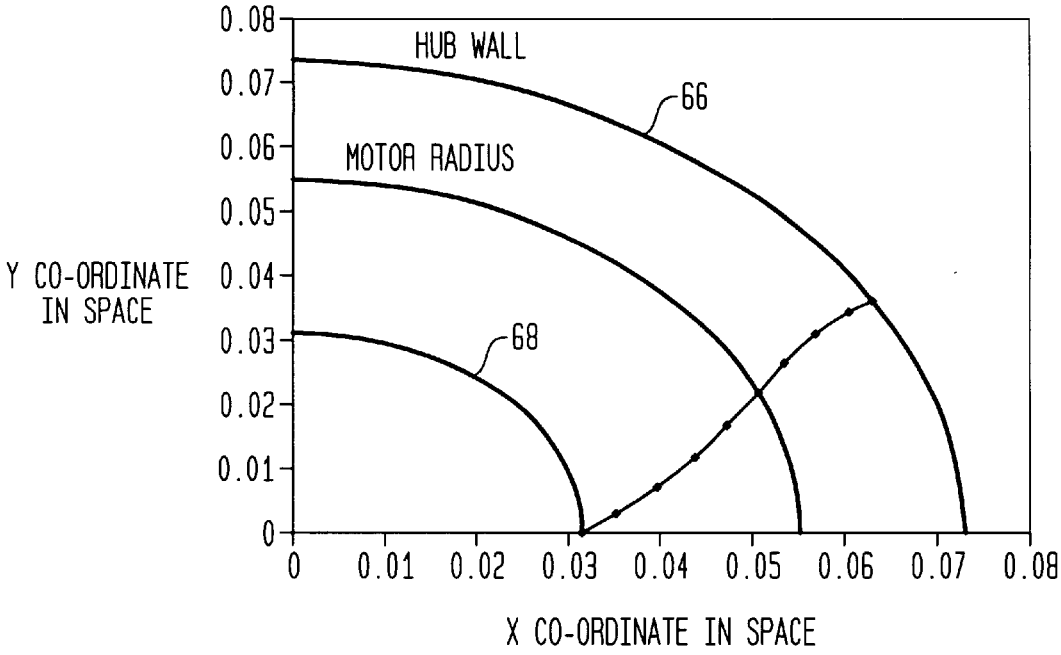
FIG. 8 is a graph of circumferential position as a function of radius of hub blades of a fan hub of the invention.
Figure 9:
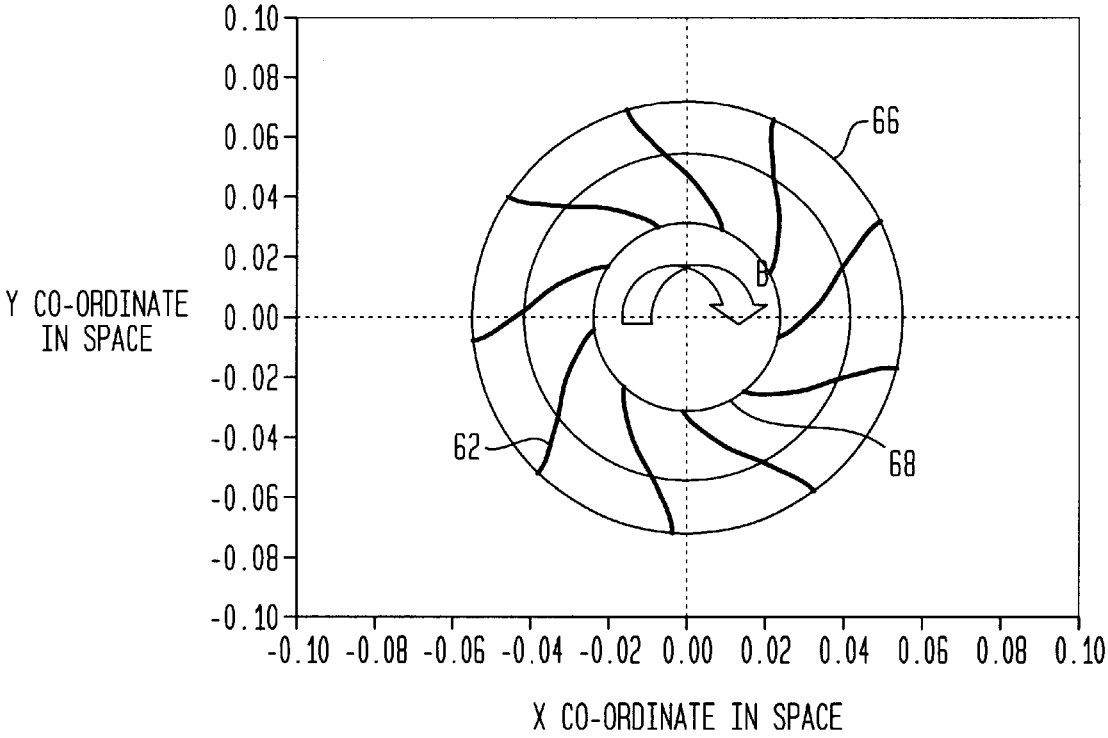
FIG. 9 is a schematic view of the shapes of the hub blades as seen from the axis of rotation.

It is preferred for moldability that the hub blades 62 do not vary in circumferential position as a function of axial position. However, the hub blades 62 should be angled to the incoming air to prevent separation. This is accomplished by designing the blades 62 to vary in circumferential position as a function of radius as shown in FIG. 8. In FIG. 8, arc 66 represents the fan hub outer diameter and arc 68 represents the starting radius of the blades 62. Thus, the hub blades 62 have curvature and define a centrifugal impeller. FIG. 9 shows the shape of the hub blades 62 as viewed from the axis of rotation. Rotation of the hub blades 62 is indicted by arrow B.

In accordance with the invention, the use of the fan hub 38 as an impeller can be expand to include the nesting of fans. As used herein, nested fans are two fans that share the same axis of rotation yet have different numbers of blades or fans of different types (e.g., centrifugal, mixed flow or axial). The embodiment of FIG. 3 shows nested fans of different types in that the blades 62 of the fan hub 38 function as a mixed flow fan and the blades 61 of fan 63 function as an axial flow fan to increase the net air flow through the module 11.

Figure 10:
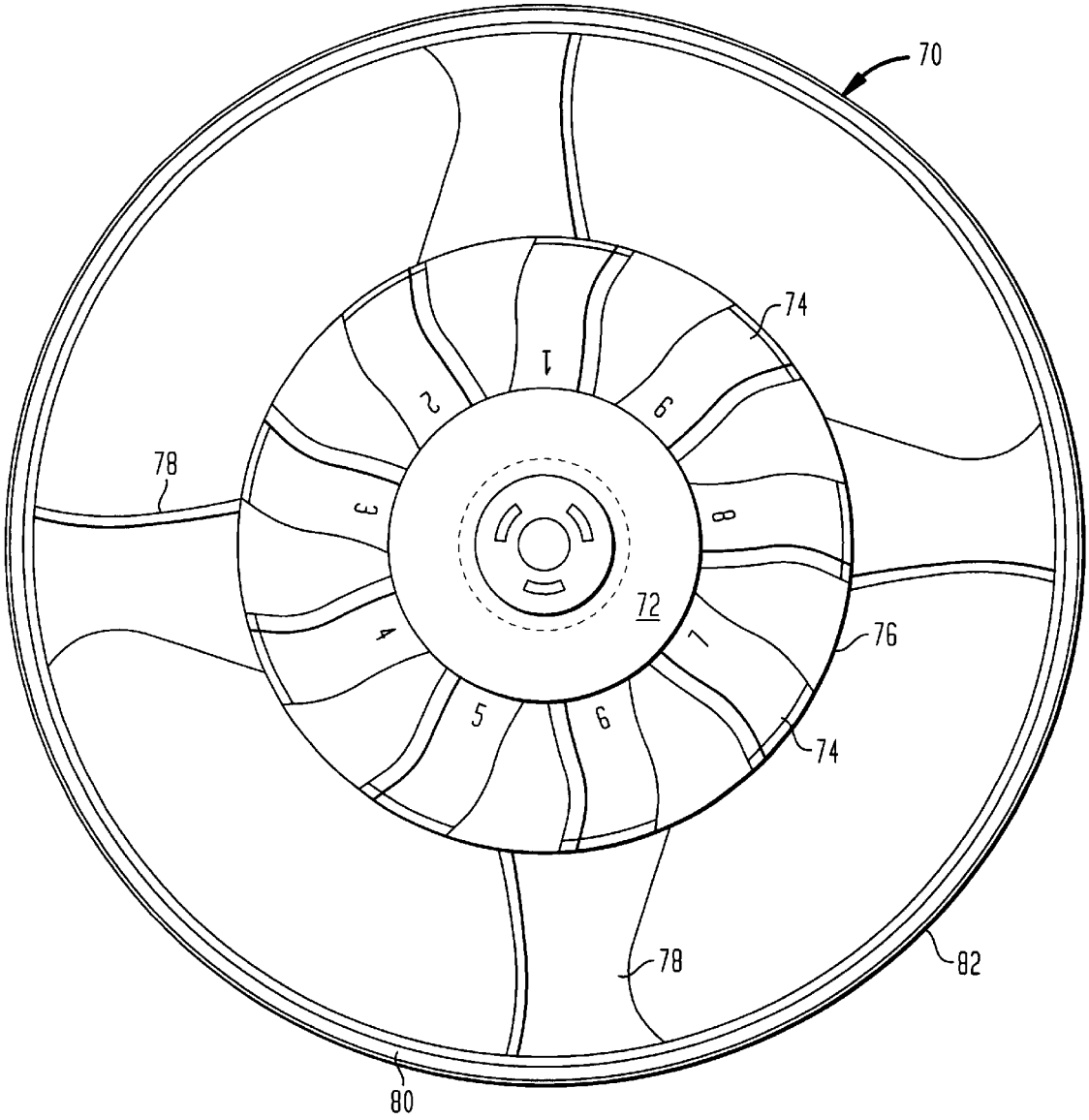
FIG. 10 is axial view of a unitary fan arrangement of the invention having an inner fan and an outer fan.

FIG. 10 shows a unitary fan structure, generally indicated at 70 defining two nested fans with different numbers of blades. The fan structure 70 is configured to be received in a shroud structure of a fan module. The fan structure 70 includes a fan hub 72. A first plurality blades 74 (nine blades in the illustrated embodiment) define an inner fan 76. A second plurality of blades 78 (four blades illustrated) extend from the inner fan 76 to an outer ring 80 to define an outer fan 82. The outer ring joins tips of the blades 78. The diameter of the outer fan is thus greater than the diameter of the inner fan.

In conventional arrangements, air flow at the fan hub is typically blocked which reduces air flow to a heat exchanger. With the nested fans and fan hub permitting flow therethrough as provided by the invention, the overall airflow through the fan module and to a heat exchanger is improved.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan shroud structure for housing blades of at least one fan, the fan shroud structure comprising;

a shroud body having a pair of opposing first sides and a pair opposing second sides, the first sides being joined with the second sides at corners forming a box-like configuration defining an interior space, the shroud body having a front end constructed and arranged to be disposed adjacent to a condenser and a back end constructed and arranged to be disposed adjacent to a radiator, generally annular wall structure within the interior space constructed and arranged to receive the blades of a fan within bounds thereof, vortex preventing structure in each said corner near said back end, said vortex preventing structure being constructed and arranged to prevent large scale eddy current generation of air in said corners as air enters the radiator, and air deflecting structure in each said corner near said front end, said air deflecting structure being constructed and arranged to deflect incoming air towards said sides, thereby improving air distribution into the fan.

2. The shroud structure of claim 1, wherein the vortex preventing structure comprises an arc-shaped member defined at a radius greater than a radius of the annular wall structure, the arc-shaped member joining a first side with a second side at each corner and having an edge which extends downstream with respect to the annular wall structure.

3. The shroud structure of claim 2, wherein the vortex preventing structure further includes rib structure extending radially from a juncture of said first and second sides to said arc-shaped member.

4. The shroud structure of claim 1, wherein said air deflecting structure comprises an air deflector disposed at a radius greater than a radius of said annular wall structure and constructed and arranged to separate air flow regions at said corners.

5. The shroud structure of claim 4, wherein said air deflector is of generally U-shaped having ends which extend towards said annular wall structure.

6. The shroud structure of claim 5, wherein said deflecting structure further includes rib structure extending radially from a juncture of said first and second sides to said air deflector, each of said rib structures having a pair of members joined to define an apex directed towards the front end of the shroud body so as to direct incoming air towards said sides.

7. The shroud structure of claim 1, wherein the shroud body includes a pair of adjacent annular wall structures defining upper and lower spaces between the annular wall structures, a pair of vortex preventing structures and a pair of air deflecting structure being provided in each of said upper and lower spaces so that one vortex preventing structure and one air deflecting structure in each of the upper and lower spaces is associated with a different annular wall structure.

8. A fan shroud structure for housing blades of at least one fan, the fan structure comprising:

shroud means for housing a fan, the shroud means having a pair of opposing first sides and a pair opposing second sides, the first sides being joined with the second sides at corners forming a box-like configuration defining an interior space, the shroud means having a front end constructed and arranged to be disposed adjacent to a condenser and a back end constructed and arranged to be disposed adjacent to a radiator, generally annular wall structure within the interior space constructed and arranged to receive the blades of a fan within bounds thereof, means for preventing vortex in each said corner near said back end, said vortex preventing means being constructed and arranged to prevent large scale eddy current generation of air in said corners as air enters the radiator, and means for deflecting air in each said corner near said front end, said air deflecting means being constructed and arranged to deflect incoming air towards said sides, thereby improving air distribution into the fan.

9. The shroud structure of claim 8, wherein the vortex preventing means comprises an arc-shaped member defined at a radius greater than a radius of the annular wall structure, the arc-shaped member joining a first side with a second side at each corner and having an edge which extends downstream with respect to the annular wall structure.

10. The shroud structure of claim 9, wherein the vortex preventing means further includes rib means extending radially from a juncture of said first and second sides to said arc-shaped member.

11. The shroud structure of claim 8, wherein said air deflecting means comprises an air deflector disposed at a radius greater than a radius of said annular wall structure and constructed and arranged to deflect air that that the velocity component around a fan axis increases.

12. The shroud structure of claim 11, wherein said air deflector is of generally U-shaped having ends which extend towards said annular wall structure.

13. The shroud structure of claim 12, wherein said deflecting means further includes rib structure extending radially from a juncture of said first and second sides to said air deflector, each of said rib structures having a pair of members joined to define an apex directed towards the front end of the shroud body so as to direct incoming air towards said sides.

14. The shroud structure of claim 8, wherein the shroud means includes a pair of adjacent annular wall structures defining upper and lower spaces between the annular wall structures, a pair of vortex preventing means and a pair of air deflecting means being provided in each of said upper and lower spaces so that one air vortex preventing means and one air deflecting means in each of the upper and lower spaces is associated with a different annular wall structure.

15. A method of distributing air in a fan shroud structure, the fan shroud structure housing a fan and including a shroud body having a pair of opposing first sides and a pair opposing second sides, the first sides being joined with the second sides at corners so as to form a box-like configuration, the shroud body having a front end constructed and arranged to be disposed adjacent to a condenser and a back end constructed and arranged to be disposed adjacent to a radiator, the method including:

preventing large scale eddy current generation of air in said corners by the fan as air exits the shroud structure and enters the radiator, and deflecting incoming air towards said sides thereby improving air distribution into the fan.

16. The method of claim 15, wherein the preventing step includes providing vortex preventing structure in each said corner near said back end, and the deflecting step includes providing air deflecting structure in each said corner near said front end.

17. A shroud structure comprising:

a shroud body, and motor mount structure coupled to the shroud body, the motor mount structure being constructed and arranged to mount a fan motor thereto and to permit axial flow of air through the motor mount structure to cool the fan motor, the motor mount structure having surfaces defining a diffuser to convert air entering the motor mount structure at velocity pressure to static pressure as the air exits the motor mount structure, wherein the diffuser is defined by an outer cone member and an inner cone member concentric with the outer cone members to define an air flow space between the cone members.

18. A shroud structure comprising:

a shroud body, and motor mounting means for mounting a motor coupled to the shroud body, the motor mounting means being constructed and arranged to mount a fan motor and to permit axial flow of air through the motor mounting means to cool the fan motor, the motor mounting means having surfaces defining a diffuser to convert air entering the motor mounting means at velocity pressure to static pressure as the air exits the motor mounting means, wherein the diffuser is defined by an outer cone member and an inner cone member concentric with the outer cone member to define an air flow space between the cone members.

19. A method of increasing airflow through a fan module, the fan module including a shroud body and a motor mount structure coupled to the shroud body, the method including:

configuring the motor mount structure to mount a fan motor thereto and to permit axial flow of air through the motor mount structure to convert air entering the motor mount structure at velocity pressure to static pressure as the air exits the motor mount structure, wherein the configuring step includes configuring the motor mount structure to include surfaces defining a diffuser, wherein the diffuser is configured to include an outer cone member and an inner cone member concentric with the outer cone member to define an air flow space between the cone members.

20. A fan module constructed and arranged to be mounted between a condenser and a radiator, the fan module comprising:

a shroud structure, motor mount structure coupled to the shroud structure, motor mount structure being constructed and arranged to permit axial flow of air through therethrough, a fan motor carried by the motor mount structure, and a fan hub driven by the motor for rotation within the shroud structure, the fan hub carrying a plurality of fan blades extending radially therefrom to define an axial flow fan, the fan hub including a plurality of hub blades defining a mixed flow impeller, the axial flow fan and the impeller sharing a common axis of rotation thereby defining nested fans to increase the net airflow through the fan module, wherein the shroud structure comprises a shroud body having a pair of opposing first sides and a pair opposing second sides, the first sides being joined with the second sides at comers so as to form a box-like configuration defining the interior space, the shroud body having a front end constructed and arranged to be disposed adjacent to a condenser and a back end constructed and arranged to be disposed adjacent to a radiator, and wherein the shroud structure further comprises:

vortex preventing structure in each said corner near said back end, said vortex preventing structure being constructed and arranged to prevent large scale eddy current generation of air in said corners as air enters the radiator, and air deflecting structure in each said corner near said front end, said air deflecting structure being constructed and arranged to deflect incoming air towards the sides, thereby improving the air distribution into the fan.

21. A fan module constructed and arranged to be mounted between a condenser and a radiator, the fan module comprising:

a shroud structure, motor mount structure coupled to the shroud structure, motor mount structure being constructed and arranged to permit axial flow of air through therethrough, a fan motor carried by the motor mount structure, and a fan hub driven by the motor for rotation within the shroud structure, the fan hub carrying a plurality of fan blades extending radially therefrom to define an axial flow fan, the fan hub including a plurality of hub blades defining a mixed flow impeller, the axial flow fan and the impeller sharing a common axis of rotation thereby defining nested fans to increase the net airflow through the fan module, wherein the fan hub is arranged with respect to the motor mount structure such that air drawn by the impeller enters the motor mount structure and passes through the motor mount structure, wherein the motor mount structure includes surfaces defining a diffuser to convert air entering the motor mount structure at velocity pressure to static pressure as the air exits the motor mount structure, wherein the diffuser is defined by an outer cone member and an inner cone member concentric with the outer cone members to define an air flow space between the cone members.

22. A fan module constructed and arranged to be mounted between a condenser and a radiator, the fan module comprising:

a shroud structure, motor mount structure coupled to the shroud structure, motor mount structure being constructed and arranged to permit axial flow of air through therethrough, a fan motor carried by the motor mount structure, and a fan hub driven by the motor for rotation within the shroud structure, the fan hub carrying a plurality of fan blades extending radially therefrom to define an axial flow fan, the fan hub including a plurality of hub blades defining a mixed flow impeller, the axial flow fan and the impeller sharing a common axis of rotation thereby defining nested fans to increase the net airflow through the fan module, wherein the motor is received in an interior space of the hub with a clearance defined between the motor and the hub, the hub including a disc constructed and arranged to deflect air away from the clearance and towards the ribs or impeller surfaces.

23. A fan module constructed and arranged to be mounted between a condenser and a radiator, the fan module comprising:

a shroud structure, motor mount structure coupled to the shroud structure, motor mount structure being constructed and arranged to permit axial flow of air through therethrough, a fan motor carried by the motor mount structure, and a fan hub driven by the motor for rotation within the shroud structure, the fan hub carrying a plurality of fan blades extending radially therefrom to define an axial flow fan, the fan hub including a plurality of hub blades defining a mixed flow impeller, the axial flow fan and the impeller sharing a common axis of rotation thereby defining nested fans to increase the net airflow through the fan module, wherein the hub blades are constructed and arranged to vary in circumferential position as a function of radius.

* * * * *